US005263832A

United States Patent [19]

Yamaguchi

[11] Patent Number: 5,263,832

[45] Date of Patent: Nov. 23, 1993

[54] AIR-COOLED OIL-FREE SCREW COMPRESSOR

[75] Inventor: Kaneki Yamaguchi, Hyogo, Japan

[73] Assignee: Kabushiki Kaisha Kobe Seiko Sho, Kobe, Japan

[21] Appl. No.: 907,593

[22] Filed: Jul. 2, 1992

[30] Foreign Application Priority Data

Jul. 5, 1991 [JP] Japan ..... 3-51855

[51] Int. Cl.[5] ..... F04C 23/00; F04C 29/02; F04C 29/04

[52] U.S. Cl. ..... 418/9; 418/83; 418/85; 418/87; 418/88; 418/89

[58] Field of Search ..... 418/9, 83, 85, 87, 88, 418/89, 101; 184/7.3

[56] References Cited

U.S. PATENT DOCUMENTS

| | | | |
|---|---|---|---|
| 1,509,917 | 9/1924 | Westinghouse | 418/87 |
| 2,152,056 | 3/1939 | Kenney et al. | 418/89 |
| 2,810,541 | 10/1957 | Thomas | 184/7.3 |
| 2,961,151 | 11/1960 | Fobian | 418/85 |
| 3,659,675 | 5/1972 | Edelstein et al. | 184/7.3 |
| 3,669,579 | 6/1972 | Carter | 418/83 |
| 3,832,980 | 9/1974 | Fujikawa et al. | 418/83 |
| 3,947,159 | 3/1976 | Mylenek | 418/83 |
| 4,526,523 | 7/1985 | Parker | 418/87 |
| 4,725,210 | 2/1988 | Suzuki et al. | 418/83 |
| 4,983,106 | 1/1991 | Wright et al. | 418/85 |

*Primary Examiner*—John J. Vrablik

*Attorney, Agent, or Firm*—Oblon, Spivak, McClelland, Maier & Neustadt

[57] ABSTRACT

An air-cooled oil-free screw compressor is provided with a first lubricating oil circulating flowpassage 1 which extends from an oil tank 20 via an oil pump 21 and an air heat exchanger 22 to cooling jackets 15 and 16 for cooling compressor bodies 12 and 13. A second such passage is connected between the cooling jackets and the oil tank and includes an oil filter 23, lubricating oil.

3 Claims, 2 Drawing Sheets

AIR-COOLED OIL-FREE SCREW COMPRESSOR

BACKGROUND OF THE INVENTION

1. Field of the Invention

The present invention relates to an air-cooled oil-free screw compressor in which lubricating oil is air-cooled.

2. Description of the Prior Art

In the past, an air-cooled oil-free screw compressor shown in FIG. 2 has been well known, which comprises a first stage compressor body 12 and a second stage compressor body 13, each of which encases therein a pair of male and female screw rotors 11 meshed with each other, and a gear box 14 which encases therein a gear for transmitting a driving force of a motor not shown to each screw rotor 11 to increase speed. There is further provided a cooling water circulating flowpassage 19 which extends from a cooling jacket 15 provided within the compressor body 12 to a cooling jacket 16 provided within the compressor body 13 and returning to the cooling jacket 15 via a water heat exchanger 17 for cooling cooling water and a pump 18. The compressor bodies 12 and 13 are cooled through the cooling jackets 15 and 16. There is still further provided a lubricating oil circulating flowpassage 25 which extends from an oil tank 20 via an oil pump 21, an air heat exchanger 22 for cooling lubricating oil and an oil filter 23 to lubricating oil supplied parts such as the gear box 14, a bearing and a shaft seal part not shown and returning to the oil tank 20, cooled lubricating oil being supplied to said lubricating oil supplied parts.

In the aforementioned conventional apparatus, the compressor bodies 12 and 13 are cooled by cooling water.

On the other hand, there are some users who cannot secure cooling water. For such users, there is considered an apparatus which circulates lubricating oil instead of water in the cooling water circulating flowpassage 19.

However, the apparatus having the aforementioned configuration has a problem in that two separate and independent flowpassages for circulating the same lubricating oil are to be provided, two pumps for delivering lubricating oil are required, and consuming power through an amount for the increased number thereof increases.

The present invention has been achieved to overcome the aforesaid problem encountered in prior art, and provides an air-cooled oil-free screw compressor which is simple in construction and enables reduction of consuming power.

SUMMARY OF THE INVENTION

For solving the aforesaid problem, according to the present invention, there are provided serially connected lubricating oil circulating flowpassage which extends from an oil tank via an oil pump and an air heat exchanger to cooling jackets for cooling compressor bodies, thence via an oil filter to lubricating oil supplied parts such as a step-up gear, a bearing and a shaft seal part, after which returning to the oil tank.

With the arrangement of the present invention, cooling of the compressor bodies and supplying of lubricating oil to the lubricating oil supplied parts are accomplished by serially connected lubricating oil circulating flowpassage.

BRIEF DESCRIPTION OF THE INVENTION

The above and other objects, features and advantages of the present invention will be more apparent from the following description taken in connection with the accompanying drawings, in which:

FIG. 1 is a view showing the whole structure of an air-cooled oil-free screw compressor according to the present invention; and FIG. 2 is a view showing the whole structure of a first conventional air-cooled oil-free screw compressor.

DESCRIPTION OF THE PREFERRED EMBODIMENT

Hereinafter the exemplary embodiment of the present invention will be described in detail with reference to the accompanying drawings.

Figure 1:
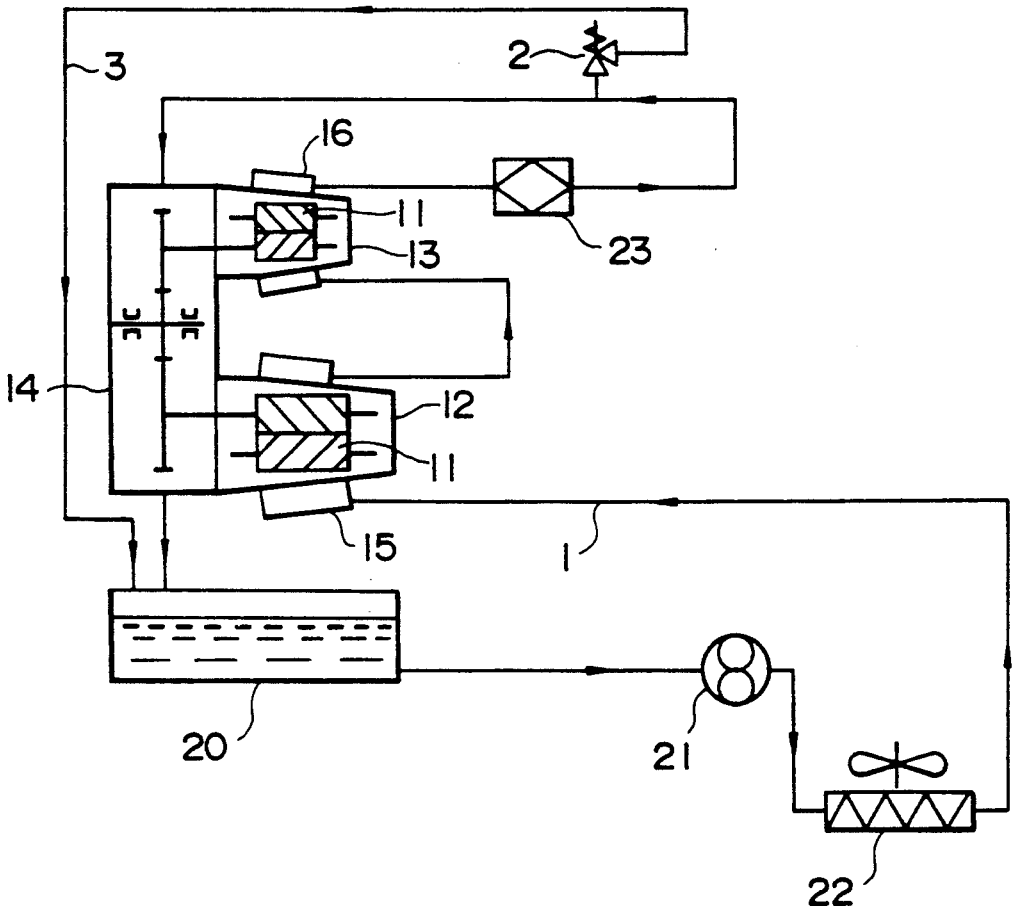
Figure 2:
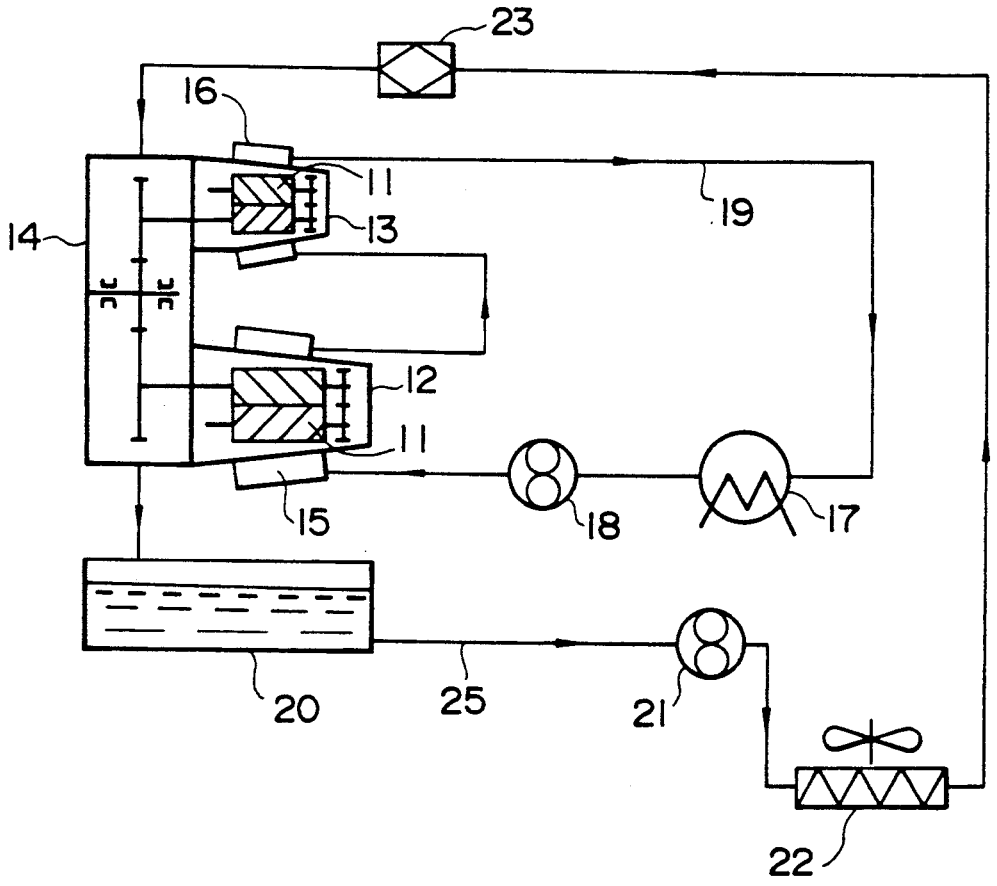
FIG. 2 PRIOR ART

FIG. 1 shows an air-cooled oil-free screw compressor according to the present invention. Parts common to those shown in FIG. 2 are indicated by the same reference numerals, description of which will be omitted.

In the present embodiment, there is provided a lubricating oil circulating circuit 1 which extends from an oil tank 20 via an oil pump 21 and an air heat exchanger 22 to a cooling jacket 15 for cooling a compressor body 12 and a cooling jacket 16 for cooling a compressor body 13. A second lubricating oil circulating circuit extends from the cooling jacket 16 to the gear box 14. It includes an oil filter 23 and supplies lubricating oil to the lubricating oil supplied parts such as the gears in gear box 14, a bearing and a shaft seal part (not shown), after which the oil is returned to the oil tank 20. With the formation as described, cooling of the compressor bodies 12 and 13 and supplying of lubricating oil to lubricating oil supplied parts such as the gears within the gear box 14 are accomplished merely by the serially connected lubricating oil circulating circuits, and one oil pump 21 will suffice.

An oil pressure regulating valve 2 is provided in the second oil circuit on the outgoing side of the oil filter 23, and a branch flowpassage 3 extending from the oil pressure regulating valve 2 to the oil tank 20 is provided so that lubricating oil in a quantity merely required is supplied to the lubricating oil supplied parts.

That is, the quantity of oil which flows toward the cooling jackets 15 and 16 for cooling the compressor bodies 12 and 13 is much more than the quantity of oil toward the lubricating oil supplied parts. When the quantity of oil toward the lubricating oil supplied parts increases, a stirring loss at those parts increases accordingly, resulting in heat generation which damages the gears and the shaft seal part (not shown). Accordingly, the quantity of oil to the lubricating oil supplied parts is determined to be a minimum quantity as required, and an upper limit thereof is also determined to prevent the inconveniences as noted above. Because of this, in the present embodiment, the branch circuit 3 is provided whereby the total quantity of lubricating oil fed out of the cooling jacket 16 is not fed to the lubricating oil supplied parts but only the quantity as required is sent.

In the present embodiment, while the apparatus has the first stage compressor body 12 and the second stage compressor body 13, it is to be noted that the number of stages of the compressor bodies is not limited in the present invention.

As will be apparent from the foregoing, according to the present invention, there is provided a first lubricating oil circulating circuit which extends from an oil tank via an oil pump and an air heat exchanger to cooling jackets for cooling compressor bodies, and a second such circuit leading from the cooling jackets to the oil tank via an oil filter, lubricating oil supplied parts such as a step-up gear, a bearing and a shaft seal part.

Because of this, cooling of the compressor bodies and supplying of lubricating oil to the lubricating oil supplied part are accomplished by a serially connected oil circulating flowpassage, and there is an effect in that reduction in consuming power can be achieved with a simple structure.

What is claimed is:

1. An air cooled oil free screw compressor comprising:

at least two driven compressor bodies;

lubricating oil supplied parts including gearing for driving said at least two compressor bodies;

an oil tank;

a cooling jacket mounted on each compressor body;

a first oil circuit including an oil pump for circulating oil from said oil tank to said cooling jackets to cool said at least two compressor bodies;

a second oil circuit, connected between said cooling jackets and said oil tank, and communicating with said lubricating oil supplied parts for supplying the oil from said cooling jackets to said lubricating oil supplied parts;

a branch oil circuit, connected between said oil tank and a portion of said second oil circuit between said one cooling jackets and said lubricating oil supplied parts, for permitting at least a portion of the oil in said second oil circuit to bypass said lubricating oil supplied parts; and an oil pressure regulating valve connected between said second oil circuit and said branch oil circuit for controlling a quantity of oil bypassing said lubricating oil supplied parts.

2. The compressor of claim 1, further including a heat exchanger in said first oil circuit.

3. The compressor of claim 1, further including an oil filter in said second oil circuit.

* * * * *